United States Patent [19]

Cotton

[11] 4,194,543

[45] Mar. 25, 1980

[54] GROOVING INDEXER FOR ROUTING APPARATUS

[75] Inventor: Lawrence M. Cotton, New Bern, N.C.

[73] Assignee: The Stanley Works, New Britain, Conn.

[21] Appl. No.: 941,851

[22] Filed: Sep. 13, 1978

[51] Int. Cl.[2] ..... B27C 5/10

[52] U.S. Cl. ..... 144/137; 33/26; 33/32 C; 144/136 C; 409/182; 409/214; 409/235

[58] Field of Search ..... 33/26, 32 C; 90/12 R, 90/12 D, 13 R, 15 R, 15 A, DIG. 3; 144/137, 144 R, 134 D, 136 C, 2 R; 409/182, 235, 214

[56] References Cited

U.S. PATENT DOCUMENTS

| | | | |
|---|---|---|---|
| 3,543,636 | 12/1970 | Tracy | 144/144 R |
| 4,102,245 | 7/1978 | Cousins | 90/15 R |

*Primary Examiner*—R. L. Spruill
*Assistant Examiner*—W. D. Bray
*Attorney, Agent, or Firm*—Prutzman, Kalb, Chilton & Alix

[57] ABSTRACT

A grooving indexer is provided for use with routing apparatus to improve the capability of the apparatus for rapidly routing straight parallel grooves in cabinet doors and similar panels. The routing apparatus is of the type in which a router is mounted on the end of a bar for extension over a panel to be routed and in which the router can be moved in any direction across the panel by reason of the bar being mounted on a carrier for longitudinal movement in one dimension of the panel, and the carrier being mounted for movement parallel to the other dimension of the panel. The grooving indexer comprises a series of stops adjustable longitudinally of the bar and a pivotal lever on the carriage biased into engagement with the stops to prevent longitudinal movement of the bar unless the lever is tripped. Although the lever may be tripped manually, mechanism is provided for tripping the lever automatically after each groove is cut so that the router is automatically released for positioning to cut succeeding grooves. An auxilliary adjustable stop may be provided for stopping the carriage for cutting selected transverse grooves.

15 Claims, 13 Drawing Figures

40
15
42
44
5
76
70
71
73
17
16
72
4
58
60
41
57
63
64
62
6
48
47
43
50
51
46
49
7

GROOVING INDEXER FOR ROUTING APPARATUS

SUMMARY OF THE INVENTION

The present invention relates to a grooving indexer for use with routing apparatus of the type disclosed and claimed in my prior U.S. Pat. No. 4,114,664 granted Sept. 19, 1978. The grooving indexer is intended to be used when it is desired to render the routing apparatus capable of rapidly routing a plurality of straight parallel grooves in cabinet doors or similar panels.

In routing apparatus of the type referred to, a router is mounted on the end of a bar which extends over the panel so that the router can cut grooves in the surface of the panel in a desired pattern. The bar is mounted on a carriage for longitudinal reciprocal movement in one dimension of the panel, and the carriage is mounted for movement at right angles thereto in the other dimension of the panel. By controlling movements of the bar and carriage, various patterns in preselected designs may be routed in the upper face of the panel.

An object of the present invention is to provide a grooving indexer which, in conjunction with routing apparatus of the type referred to, permits the operator to rapidly rout parallel straight grooves in cabinet doors or similar panels.

A further object is to provide such a grooving indexer which is semi-automatic in operation thereby insuring accuracy with the use of minimum skill even though the mechanism is being operated at high speed.

Another object is to provide a grooving indexer as described which is simple to set up and adjust to vary the placement and spacing of the grooves produced by the router whereby a variety of designs may be created as desired.

Another object is to provide a grooving indexer which is dependable in operation and capable of high speed operation over extended periods of time whereby routed panels may be produced at a high output rate.

Other objects will be in part obvious and in part pointed out in more detail in the following description and the accompanying drawings which set forth an illustrative embodiment of the invention.

DESCRIPTION OF THE PREFERRED EMBODIMENT

Figure 1:
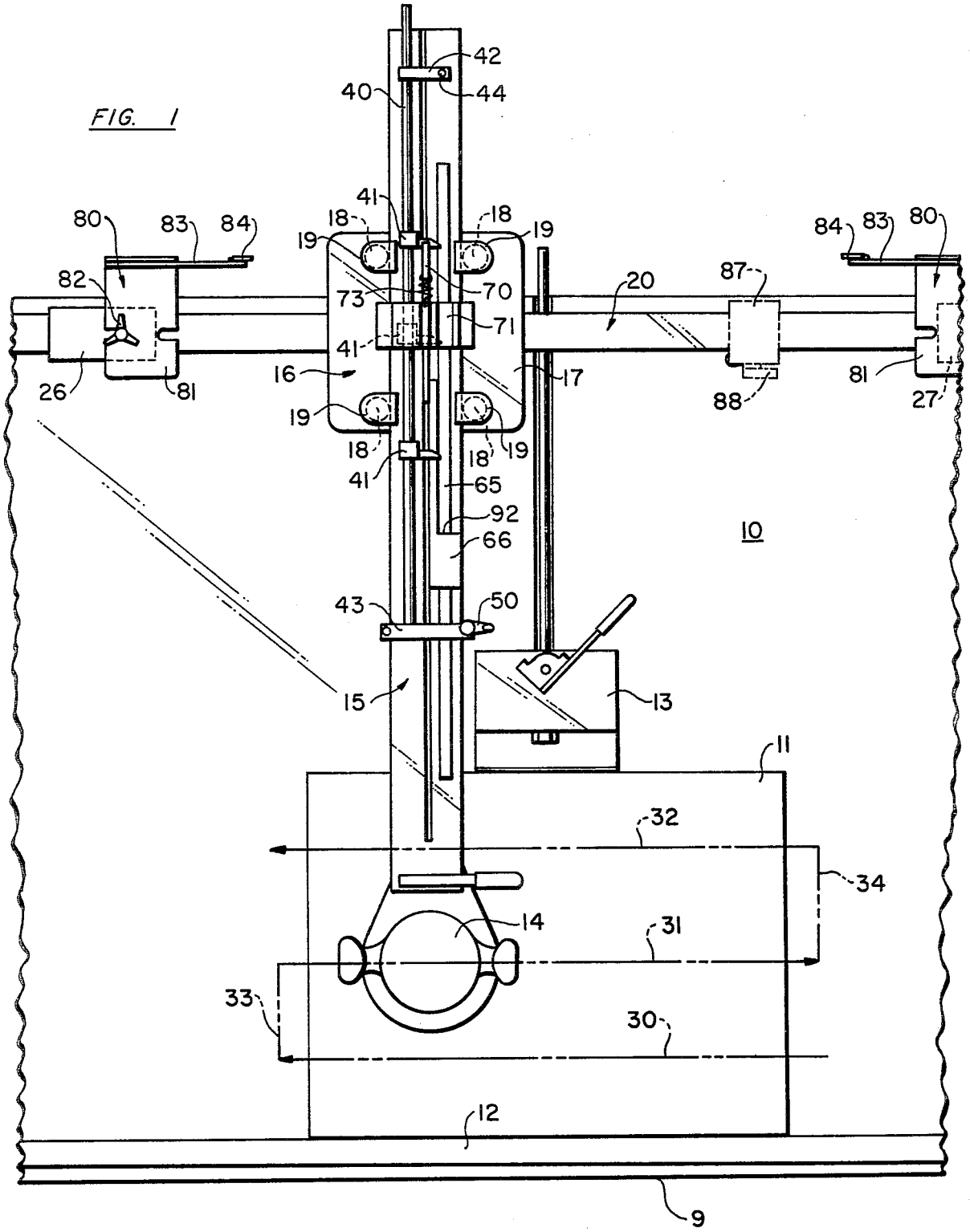
FIG. 1 is a fragmentary plan view of a routing apparatus to which a grooving indexer embodying my invention has been applied.

Referring to the drawings showing a preferred embodiment of the invention, the grooving indexer of the invention is used as an attachment for a routing apparatus of the kind disclosed and claimed in my prior U.S. Pat. No. 4,114,664 issued Sept. 19, 1978. Only that portion of the routing apparatus which is necessary for an understanding of the present invention is shown and described herein. Reference may be had to said prior U.S. Pat. No. 4,114,664 if further information concerning the routing apparatus is desired.

In the drawings, the routing apparatus is shown as having a base or work table 10 on which a cabinet door or similar panel 11 is placed so that its upper surface can be routed to produce the desired design. For the routing operation, the panel is turned on its side with its upper end to the left as viewed in FIG. 1 and it is firmly clamped against the locating ledge 12 by means of the adjustable clamp 13. The panel 11 is generally centered on the base 10 so that the router 14 which, as described later, is mounted for movement from right to left of the panel 11 as viewed in FIG. 1 can move beyond both the right and left edges during a routing operation. During a routing operation, the operator stands at the front of the apparatus in front of the forward edge 9 near which the locating ledge 12 is mounted.

Figure 2:
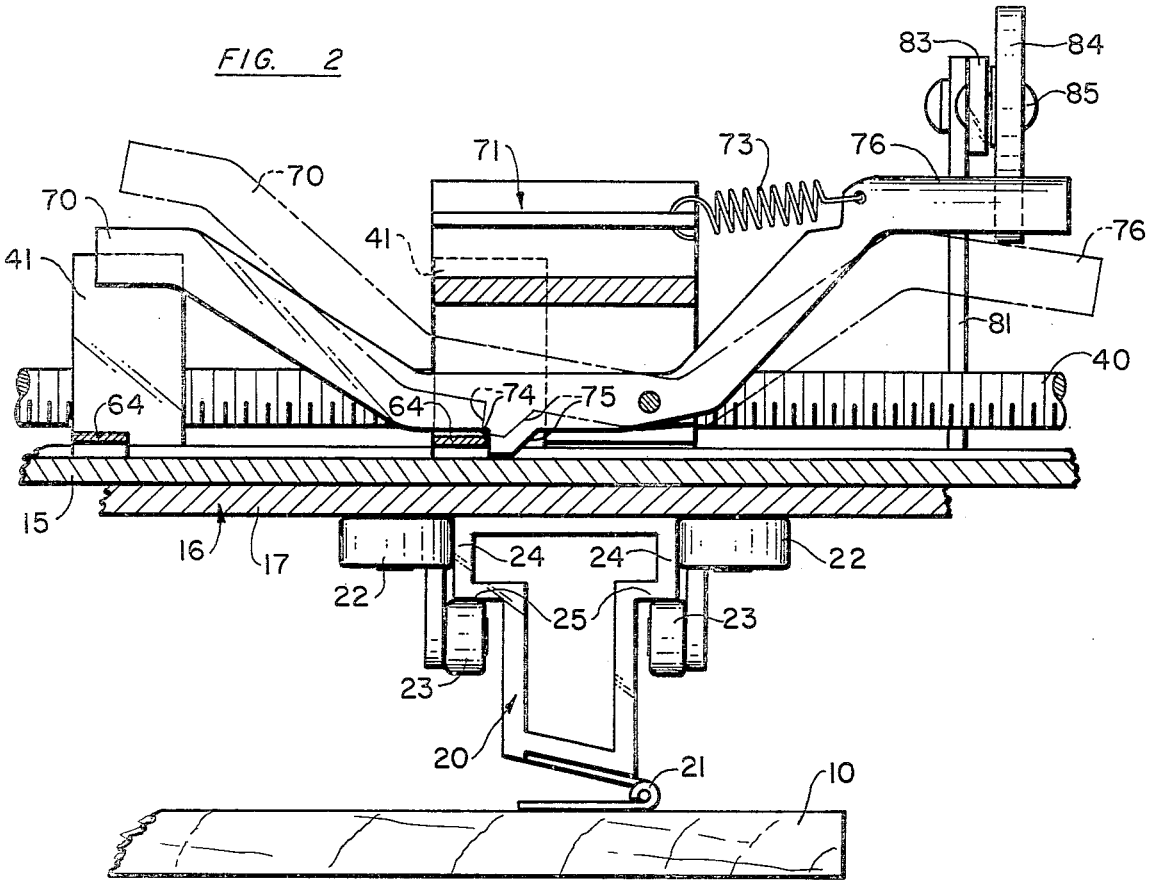
FIG. 2 is an enlarged fragmentary side view, partially in cross-section taken from the right hand side of the apparatus as viewed in FIG. 1.

As shown in FIG. 1, the router 14 is mounted on the end of a bar 13 which extends across the base 10 at right angles to the panel locating ledge 12. The bar 15 is mounted for longitudinal sliding movement on a carriage 16 which has a base plate 17 provided with rollers 18 between which the bar 15 is seated. The bar is held in seated position between the rollers 18 by overhanging lips on the dust covers 19. As shown in FIGS. 1 and 2, the carriage base plate 17 in turn is mounted on a rail 20 which is generally T-shaped in cross-section and which is attached to the base 10 by means of a longitudinally extending piano hinge 21. The carriage base plate 17 is slidable longitudinally on the rail 20 and is retained thereon by rollers 22 and 23 which, respectively, engage the side edges 24 and shoulders 25 of the rail. The rail 20 extends parallel to the panel locating ledge 12.

As a result of the structure as thus far described, it will be apparent that the router 14 is mounted so that it can be moved in one dimension of the panel 11 by reciprocating the bar 15 in the carriage 16 and can be moved in the other dimension of the panel by movement of the carriage 16 along the rail 20. Therefore, by combining these movements, the router 14 can be moved (within limits) in any direction parallel to the plane of the panel 11. Adjustable stops 26 and 27 slidably mounted on the rail 20 are normally used to limit the extent of movement of the carriage 16 along the rail 20.

The grooving indexer of my present invention comprises a number of parts to be next described which are attached to the bar 15 and adjustable stops 26 and 27. The parts attached to the bar 15 are adapted to retain the bar in preselected longitudinal positions on the carriage enabling the router 14 to cut along parallel longitudinal lines such as indicated by the dotted lines 30, 31 and 32 in FIG. 1. The parts attached to the stops 26 and 27 are used to automatically release the bar for longitudinal movement when the router is beyond the ends of the panel 11 to permit the router to move from one line of cut to another such as indicated by the dotted lines 33, 34.

Figures 3, 5, 6, 7:
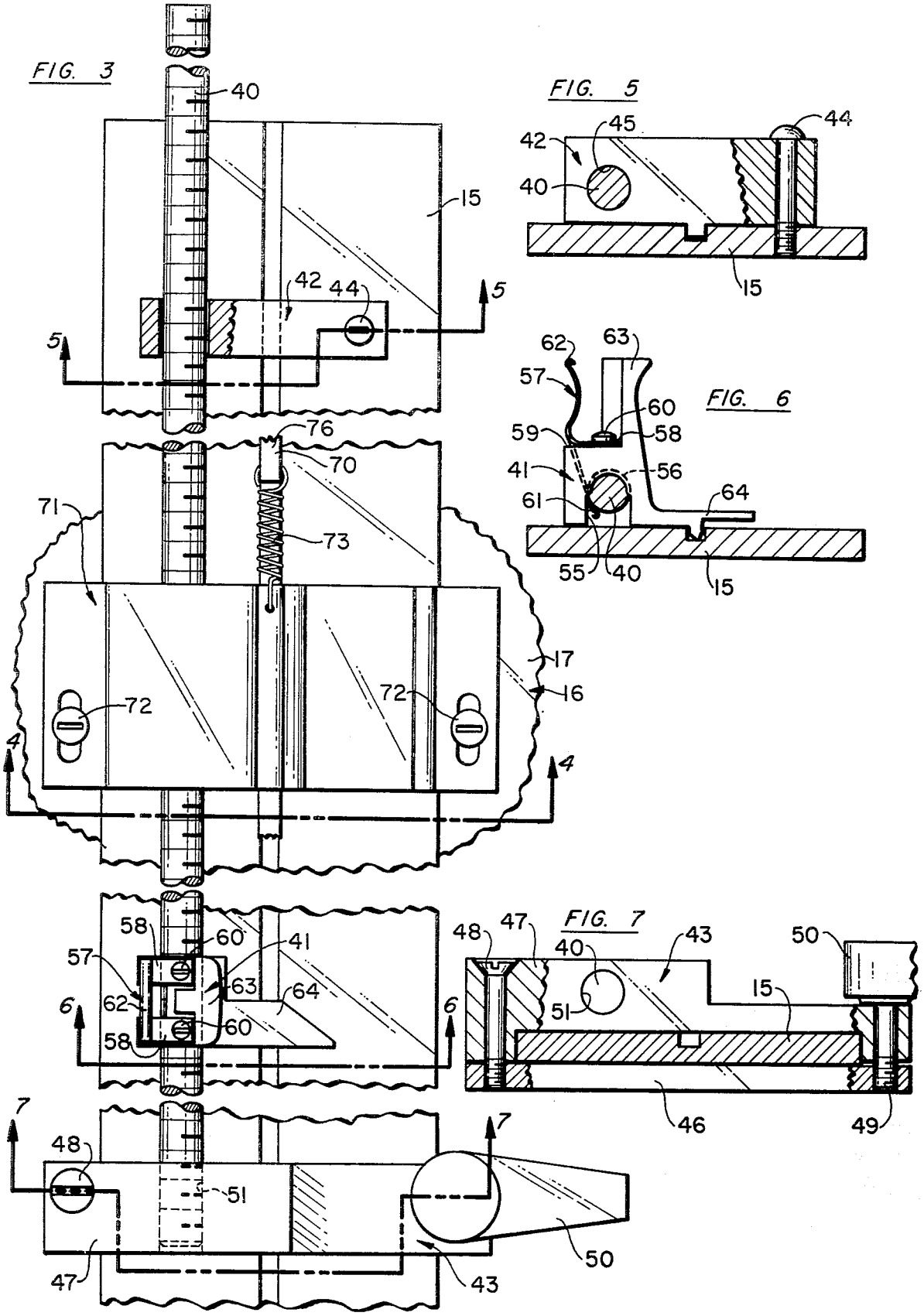
FIG. 3 is an enlarged fragmentary plan view of the router supporting bar of the routing apparatus.
FIG. 5 is a cross-sectional view taken along the line 5—5 of FIG. 3.
FIG. 6 is a cross-sectional view taken along the line 6—6 of FIG. 3.
FIG. 7 is a cross-sectional view taken along the line 7—7 of FIG. 3.
Figure 4:
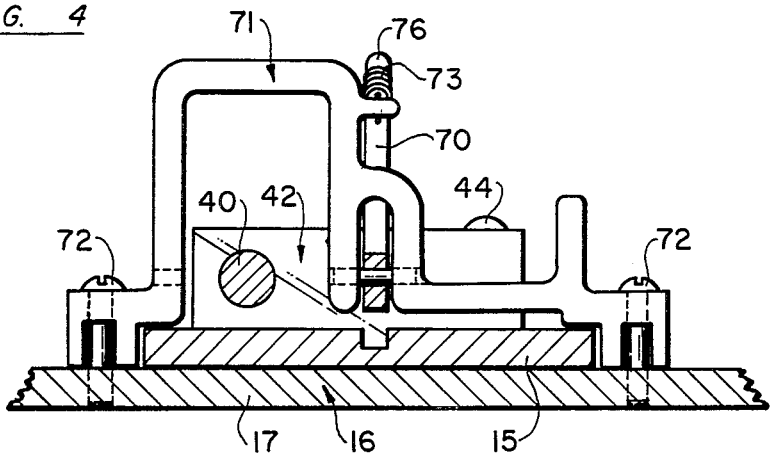
FIG. 4 is a cross-sectional view taken along the line 4—4 of FIG. 3.

The parts attached to the bar 15 comprise a threaded rod 40 on which may be mounted a plurality of adjustable stops 41. In the drawing, three such stops 41 are shown although, as will be apparent, the number can be more or less depending on the number of parallel router cuts it is desired to route in the panel 11. The rod 40 extends longitudinally along the top of the bar 15 as shown and is adjustably attached thereto by a fixed holder 42 and a movable holder 43. The fixed holder 42 is attached to the bar 15 by a screw 44 and has a through bore 45 providing a snug sliding fit for the threaded rod 40 which extends therethrough. The movable holder 43, as best shown in FIG. 7, is a two-part structure comprising a bottom plate 46 extending under the bar 15 and a top block 47 extending across the top, the plate 46 and block 47 being connected together at one end by the screw 48. The other ends are attached together by a screw 49 to which a lever 50 is affixed and by means of which the screw 49 can be manually loosened or tightened. The block 47 has a threaded opening 51 into which the end of the rod 40 is threadably engaged. As will be apparent, when the screw 49 is loosened, the holder 43 with rod 40 attached can be adjusted longitudinally on the bar 15 and then, by tightening the screw 49, the holder can be clamped in the selected adjusted position.

The stops 41, as best seen in FIGS. 3 and 6, have a groove 55 in their underside which is rounded at the top and partially threaded as indicated by the dotted line 56 which enables the stops 41 to be seated on the rod 40 with the respective threads intermeshed. This prevents the stops 41 from sliding out of selected position on the rod 40 unless deliberately released. The stops are normally held in interengaged relationship with the rod 40 by a spring member 57 having a pair of ears 58 secured to the ledge 59 by screws 60. A lower leg 61 of the spring members 57 normally engaged underneath the threaded rod 40 and an upper leg 62 acts as a thumbpiece by means of which the stop can be released from the rod 40 for removal or placement in a different position. The ears 58 form a hinge permitting the lower leg 61 and upper leg 62 to pivot in unison when the person adjusting the stop presses the upper leg 62 toward the upright portion 63 which can be conveniently done by placing the side of the forefinger against the upright portion 63 and pressing inwardly on the spring leg 62 with the thumb. The outwardly extending foot 64 acts as an abutment which performs the stopping function as described hereinafter and also serves as a pointer cooperating with the scales 65 and 66 to indicate where the groove resulting when that stop is used will appear on the panel 11.

Cooperating with the stops 41 is a releasable latch comprising a lever 70 pivotally mounted on a bridge 71 which extends over the bar 15 and is secured to the carriage 16 by screws 72. As best shown in FIG. 2, the lever 70 is biased in a counter clockwise direction as viewed in FIG. 2 by a spring 73 and when in the full line position shown in FIG. 2 has a shoulder 74 engageable with the foot 64 of a stop 41. However, when the lever 70 is pivoted to the dotted line position, the shoulder 74 is disengaged, releasing the stop. The rear surface 75 of the shoulder 74 is inclined as shown so that when the bar 15 is moved from right to left as viewed in FIG. 2, the lever 70 will be cammed upwardly and over the foot 64 without causing an obstruction. Accordingly, the operator standing at the front of the apparatus can always pull the bar 15 and attached router 14 toward him, but movement in the opposite direction will be prevented when the shoulder 74 engages a stop 41. By keeping the bar 15 pressed rearwardly with a stop 41 engaged against the shoulder 74 of the lever 70 and moving the router holding assembly from right to left or vice versa, this being permitted by sliding movement of the carriage 16 longitudinally on the rail 20, the router 14 will cut a groove across the panel 11 parallel to the ledge 12. The location of the groove on the panel, i.e. the distance from the ledge 12, will depend on the location of the engaged stop 41 on the bar 15. If several stops 41 are engaged in sequence, then a series of parallel grooves can be cut in sequence on the panel.

As will be apparent, the lever 70 can be manually rocked to release it from a stop 41 merely by lifting up on the front end which is the left hand end as viewed in FIG. 2. However, in accordance with the invention, means are provided for tripping the lever 70 automatically after the completion of each groove cutting operation whereby the stops 41 may be engaged sequentially permitting parallel grooves to be routed quickly and accurately in predetermined pattern. The tripping assemblies 80 are mounted on the adjustable stops 26 and 27 and each comprises an L-shaped supporting plate 81 which is secured to the stop by a holding knob 82 as shown in connection with the assembly mounted on the stop 26 at the left hand side of the rail 20 as viewed in FIG. 1. Extending inwardly from the supporting plate 81 is an arm 83 on the free end of which is a freely pivotal tripper cam 84. The tripper cam 84 is so shaped that its center of gravity is well below the pivot 85 causing the tripper cam 84 to normally assume the position shown in FIGS. 8A, 8B and 8C. A stop pin 86 limits pivoting movement of the tripper cam 84 to about 90°.

Figure 8A:
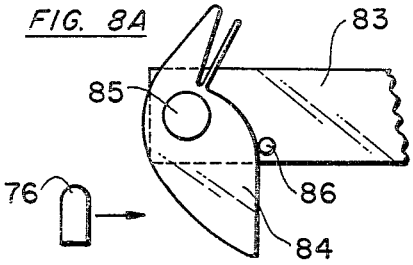
FIGS. 8A, 8B, 8C and 8D are fragmentary elevational views of the tripping mechanism showing the sequence of operational steps.
Figure 8B:
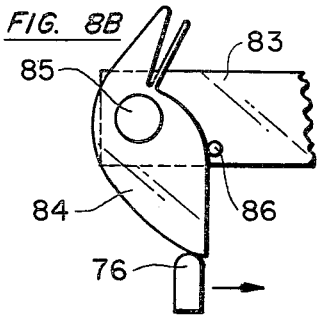
Figure 8C:
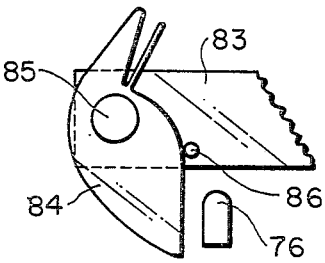
Figure 8D:
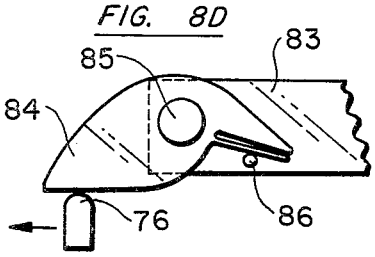

The tripper assemblies 80 when mounted on the adjustable stops 26 and 27 as shown, are in alignment with the path of movement of the rearwardly extending end portion 76 of the lever 70. Accordingly, the tripper cam 84 is adapted to depress the end portion 76 when the carriage 16 is moved sufficiently to cause them to engage. The sequence of operation is best illustrated in FIGS. 8A–8D showing what occurs when the carriage 16 is moved to the right so that the end 76 of the lever engaged the tripper cam 84 of the tripper assembly mounted on the adjustable stop 27. As shown in FIGS. 8A and 8B, the cam 84 extends downwardly into the path of the end 76 and is prevented from rotating in a counterclockwise direction by the pin 86. Accordingly, as the end 76 moves to the right, it is cammed downwardly tripping the lever 70 and releasing the shoulder 74 from engagement with the stop 41. The operator can now move the bar 15 and attached router rearwardly and this will occur automatically since in the normal operation of the apparatus, the operator will be applying pressure to the router in a rearward direction. Once the end 76 passes the cam 84 as shown in FIG. 8C, it is released permitting the shoulder 74 of lever 70 to engage the succeeding stop 41. Upon return movement of the carriage and lever 70, the cam 84 is merely pivoted out of the way as shown in FIG. 8D and will not trip the lever 70. As will be apparent, the adjustable stops 26, 27 on which the tripper assemblies 80 are mounted are always placed outwardly a sufficient distance from the midpoint of the panel 11 so that when the lever 70 is tripped, the router 14 will be off the panel 11. A typical sequence of operation is illustrated by the dotted lines 30–34 in FIG. 1. Assuming the router is moved forwardly sufficiently to engage the first stop 41 with the lever 70 and is operated from right to left as viewed in FIG. 1, the router will cut a groove along the line 30 until it completely clears the panel 11 whereupon the lever 70 will be tripped and the router will be moved rearwardly along line 33 until the next stop 41 is engaged. The router 14 can then be moved from left to right cutting a groove along the line 31 until it passes off the panel 11 causing the lever 70 to again be tripped permitting the router to be moved rearwardly along the line 34 into position for routing along the line 32.

For simplicity of presentation, the routing of the grooves in the panel 11 has been described as producing evenly spaced grooves generally centered in the panel. As will be apparent, the adjustable stops 41 do not have to be evenly spaced and by varying the spacing, it is possible to produce randomly spaced grooves with equal or unequal margins from the edge of the panel. To expedite the setting up of the apparatus for a routing operation, the fixed scale 65 on the bar 15 can be used to set the distance between the sequence of stops 41 on the threaded rod. This scale has indicia showing the varying distances of the router 14 from the ledge 12 as the bar 15 is moved relative to the carriage 16. A movable second scale 66 is used to select the position of the sequence of grooves in the panel. For this purpose the scale 66 has a shoulder 92 which is placed with its upper edge on the scale 65 at the indicia marking the width of the panel, i.e. the location of the edge of the panel opposite from the ledge 12. The rod 40 with stops 41 attached can then be adjusted to obtain the desired margins for the first and last grooves. For example, if the first and last stops 41 read the same on both the fixed scale 65 and movable scale 66, the resulting groove pattern will be centered on the panel 11.

Figure 9A:
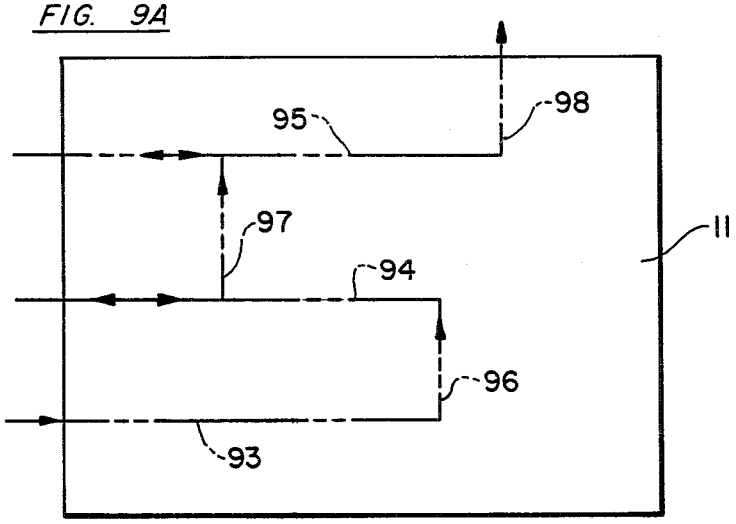
FIGS. 9A and 9B are plan views, partially diagramatic, of a panel showing the sequence of routing steps to create a design simulating random planking.
Figure 9B:
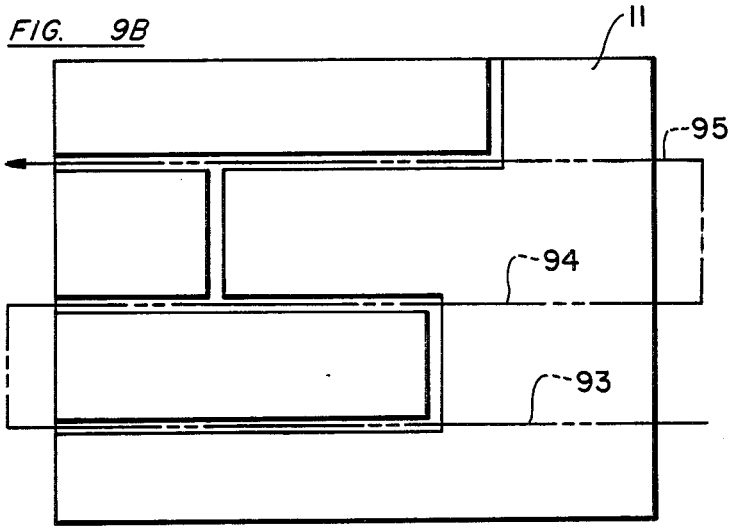

While the grooving indexer will normally be used only to cut parallel grooves from end to end of the panel 11, it is also possible to use the apparatus to cut grooves in the panel 11 simulating random planking. This is illustrated in FIGS. 9A and 9B of the drawings, the simulation of random planking being accomplished by cutting random transverse grooves between two or more of the parallel grooves. As a specific example, the apparatus can be set up in the manner previously described to cut parallel grooves along the dotted lines 93, 94 and 95. In order to make the connecting cut 96, an adjustable stop 87 shown in phantom in FIG. 1 is placed on the rail 20 and located so that it will be abutted by the carriage 16 when the router 14 is in position to make the cut 96 where desired. The stop 87 is locked in position by clamping means not shown operated by the handle 88. Commencing at the left hand end of the panel with the lever 70 engaging the first stop 41, the router 14 is moved to the right along the line 93 until the carriage 16 engages the stop 87. The operator can then manually trip the lever 70 and, by keeping the carriage against the stop 87, can then accurately cut the groove along line 96 until the lever 70 engages the next stop 41. The router can then be returned to the left along the line 94. By resetting the stop 87 and beginning at the left hand end of line 94, it is then possible to route along the lines 94 and 97 and to return along line 95. Similarly, the router can be returned along the line 95 to a new stopped position and then moved to cut along the line 98. As a final step, as illustrated in FIG. 9B, the router is used to complete the cutting of the parallel grooves from edge to edge following the dotted lines 93, 94 and 95 in sequence. For best results, this last routing operation is carried out with the router adjusted to produce a slightly greater depth-of-cut. Variations in the design shown in FIGS. 9A and 9B may be made as desired.

As will be apparent from the foregoing description, the grooving indexer of my invention greatly improves the capability of the routing apparatus for routing designs in a panel when the design includes parallel grooves either evenly or randomly spaced. The indexer is simple to use and versatile for providing wide variations in the designs as desired.

As will be apparent to persons skilled in the art, various modifications, adaptations and variations of the foregoing specific disclosure may be made without departing from the teachings of the present invention.

I claim:

1. A grooving indexer attachment for routing apparatus of the type having a base, means for securing a panel to be routed in predetermined position on the base, a rail extending parallel to one edge of a panel secured in said predetermined position, a carriage mounted on the rail for movement along the rail, and a bar having means for mounting a router on the end thereof mounted on the carriage for longitudinal reciprocal movement and extending over the base at right angles to the rail, said attachment comprising a plurality of stops mounted on the bar in longitudinally spaced relationship, and a releasable latch mounted on the carriage for engagement sequentially with said stops, whereby the bar may be held in a series of predetermined longitudinal positions to permit the routing of a plurality of parallel grooves in sequence in a panel.

2. A grooving indexer attachment as defined in claim 1 wherein the releasable latch is a lever, and means is provided for pivotally mounting the lever on the carriage.

3. A grooving indexer attachment as defined in claim 1 wherein means are included for mounting the stops in variable selected positions along the bar, and the stops are formed with abutments for engagement sequentially by the latch when the bar is moved longitudinally on the carriage.

4. A grooving indexer attachment as defined in claim 3 wherein the means for mounting the stops comprises a rod attachable lengthwise of the arm, and the stops have means for positioning the stops selectively along the rod.

5. A grooving indexer attachment as defined in claim 4 wherein means are provided for mounting the rod adjustably lengthwise on the bar.

6. A grooving indexer attachment as defined in claim 4 wherein the rod is threaded, the stops have a partially threaded arcuate portion adapted to be seated on the rod, and releasable means are provided for holding the stops in seated position on the rod.

7. A grooving indexer attachment as defined in claim 2 wherein the lever mounting means pivotally mounts the lever in alignment with the bar, and the lever has a shoulder for engagement with the stops when the lever is in predetermined pivoted position on the carriage.

8. A grooving indexer attachment as defined in claim 7 wherein biasing means is provided biasing the lever to said predetermined pivoted position.

9. A grooving indexer attachment as defined in claim 1 wherein tripping means is provided for automatically releasing the latch when the carriage is moved along the rail sufficiently to permit the router to completely cut a groove across the panel.

10. A grooving indexer attachment as defined in claim 9 wherein the latch is a lever adapted to be pivotally mounted on the carriage, and the tripping means is a cam adapted to be mounted for engagement by the lever when the carriage is moved along the rail sufficiently to place the router beyond the end of the panel.

11. A grooving indexer attachment as defined in claim 8 wherein cam means is provided for moving the lever away from said predetermined pivoted position when the carriage is moved along the rail sufficiently to place the router beyond the end of the panel.

12. A grooving indexer attachment as defined in claim 9 wherein tripping means are provided to be adjustably mounted on the rail on opposite sides of the carriage.

13. A grooving indexer attachment as defined in claim 11 wherein cam means is provided for attachment in adjustable positions on the rail on opposite sides of the carriage.

14. A grooving indexer attachment as defined in claim 1 wherein an adjustable carriage stop is provided for attachment to the rail.

15. A grooving indexer attachment as defined in claim 8 wherein an adjustable carriage stop is provided for attachment to the rail, and the lever is adapted to be manually pivoted away from said predetermined pivoted position when the carriage is in engagement with the carriage stop.

* * * * *